US007012200B2

(12) United States Patent
Møller

(10) Patent No.: US 7,012,200 B2
(45) Date of Patent: Mar. 14, 2006

(54) INTEGRATED VOLUME CONTROL AND SWITCH ASSEMBLY

(75) Inventor: Niels Thor Møller, Borup (DK)

(73) Assignee: Sonion Roskilde A/S, Roskilde (DK)

( * ) Notice: Subject to any disclaimer, the term of this patent is extended or adjusted under 35 U.S.C. 154(b) by 0 days.

(21) Appl. No.: 10/777,632

(22) Filed: Feb. 13, 2004

(65) Prior Publication Data

US 2005/0178644 A1 Aug. 18, 2005

(51) Int. Cl.
*H01H 19/58* (2006.01)

(52) U.S. Cl. ..... 200/11 A; 200/11 G

(58) Field of Classification Search ..... 200/11 R, 200/11 G, 526–528, 292, 416, 417, 533, 200/570, 573, 574, 11 A, 11 D, 11 H, 564, 200/571, 336; 338/198, 200, 215
See application file for complete search history.

(56) References Cited

U.S. PATENT DOCUMENTS 3,195,358 A 7/1965 Bair et al.
4,081,782 A 3/1978 Hildreth et al.
4,117,444 A 9/1978 Hildreth et al.
4,329,676 A 5/1982 McDonald
4,891,476 A * 1/1990 Nation et al. ..... 200/11 R
5,049,709 A * 9/1991 Prickett et al. ..... 200/527
5,178,265 A * 1/1993 Sepke ..... 200/528
5,186,316 A * 2/1993 Mortun et al. ..... 200/527
5,380,965 A 1/1995 Moller
5,438,172 A * 8/1995 Fowler et al. ..... 200/11 R
5,967,301 A * 10/1999 Reed et al. ..... 200/523
6,369,691 B1 * 4/2002 Chiu ..... 338/172
6,809,281 B1 * 10/2004 Miki ..... 200/529

FOREIGN PATENT DOCUMENTS

EP 341904 * 11/1989

OTHER PUBLICATIONS

European Search Report issued Oct. 29, 2004.

* cited by examiner

*Primary Examiner*—Elvin Enad
*Assistant Examiner*—Lisa Klaus
(74) *Attorney, Agent, or Firm*—Harness, Dickey & Pierce, P.L.C.

(57) ABSTRACT

An integral volume control and switch assembly comprising a resilient conductive member serving for switching between a first and second switch state and a resilient tactile member serving for providing a user with a tactile feedback upon change of switch state. The resilient tactile member and the resilient conductive member are formed by separate members. Hereby the assembly can be further miniaturised without the resilient tactile member and the resilient conductive member being too small to handle in a manufacturing process. In addition, it is possible to adjust angular position of the rotatable member where switch function and tactile feedback occurs. Preferably the resilient tactile member and the resilient conductive member are spatially separated along a rotational axis of the rotatable member. The assembly according to the invention is suitable for hearing aids.

26 Claims, 5 Drawing Sheets

INTEGRATED VOLUME CONTROL AND SWITCH ASSEMBLY

FIELD OF THE INVENTION

The present invention relates to an integrated volume control and switch assembly comprising a combined potentiometer and switch function. In particular, the assembly is suitable for use in hearing aids and portable communication devices.

BACKGROUND OF THE INVENTION

Known potentiometers may in addition to a variable resistance function have a built-in switch that provides the option of changing between first and second switch states via the potentiometer knob—typically in an extreme position of the potentiometer knob. The potentiometer may function as a volume control where the potentiometer knob upon turning in one direction decreases the volume, and finally turns off the signal and/or switches off power. Preferably, the user is provided with feedback indicating that the switch has reached an off state, e.g. light in a display or diode, a sound, a tactile mechanical resistance towards turning of the knob, or similar. In relation to volume controls for portable audio equipment feedback is often provided to the user by a tactile feedback upon turning a rotatable volume control knob to or beyond its lowermost position. Hereby, the user has a indication that the device has been switched off so as to save battery without the need for visual confirmation or feedback.

PJ 88 manufactured by the applicant is an example of a potentiometer with a built-in switch providing the user with a tactile feedback. PJ 88 is suited for miniature applications, such as a combined volume control and on/off switch in a hearing aid. PJ 88 provides a combined switch function and tactile feedback arranged by engagement of two metal springs upon interaction with a protrusion on a user rotatable part. The two metal springs are both engaged with the switch function as well as the tactile feedback function.

The combined switch and tactile feedback arrangement provided in PJ 88 has a number of disadvantages that are particularly troublesome with respect to further miniaturisation. The two metal springs are small when compared to an overall size of the potentiometer assembly. This means that the solutions are not suited for further miniaturisation, since a pure downscale of such potentiometers would include mechanical parts being too complicated to manufacture and handle in a cost efficient production process.

An additional problem with PJ 88 is that it is not possible to independently adjust an angular position of the user rotatable part where the switch function and the tactile feedback occur.

SUMMARY OF THE INVENTION

One object of the present invention is to provide an integrated volume control and switch assembly of a simple design that provides tactile feedback to a user of the assembly in connection with the switch function. The assembly must be suited for miniature applications, such as hearing aids, and still suited for cost efficient production.

An additional object is to provide an integrated volume control and switch assembly providing independently adjustable switch and feedback functions.

The mentioned objects are complied with by providing, in a first aspect, an integrated volume control and switch assembly comprising a base plate being penetrable by first and second conductive switch legs, the base plate further supporting a resilient conductive member adapted to establish an electrical connection between the first and second conductive switch legs in a first switch state of the assembly, and adapted to break said electrical connection in a second switch state, a variable resistance means responsive to an angular position of a rotatable member, the variable resistance means being electrically connected between third and fourth conductive legs, and a resilient tactile member adapted to provide a tactile feedback to a user at a predetermined angular position of the rotatable member, to indicate to the user, a change between the first and second switch states, wherein the resilient tactile member and the resilient conductive member are formed by separate members.

It is understood that even though denoted "legs" the first and second conductive switch legs may be formed differently than long slim members or pins. For example the switch legs may be formed by conductive bumps adapted for soldering or they may be formed by pieces of Printed Circuit Boards (PCB), pieces of flexprint or flexible wires etc.

The invention is particularly advantageous in that it is possible to manufacture the assembly in miniature versions without the need for components being so small that they are difficult to handle in a mass production line. This is accomplished by the fact that the switch function and the tactile feedback function are formed by separate members. Hereby, the separate members can be independently positioned in the assembly thus allowing each member to be located in positions with more space available.

An additional advantage is that the independent switch function and tactile feedback function allow independent choice of angular position of the rotatable member for switching and for tactile feedback. Once the assembly has been designed it is possible by simple changes to adjust a relative angular position of the rotatable member where switching and tactile feedback occurs—switching and tactile feedback need not be provided at the same angular position of the rotatable member.

The integral volume control and switch assembly may have the resilient tactile member (35) and the resilient conductive member (8) spatially separated along a rotational axis of the rotatable member (40). The resilient conductive member (8) and the switch legs (2,3) may constitute separate members.

The assembly may further comprise an intermediate link (20) rigidly connected to the rotatable member (40), the intermediate link (20) comprising a protrusion (21) being adapted to engage with the resilient conductive member (8) so as to either establish or break the electrical connection between the first (2) and second (3) switch legs.

The assembly may further comprise an intermediate housing (30) part being rigidly connected to the base plate (1), the intermediate housing part (30) having a top portion aligned with the base plate (1), wherein the top portion supports the resilient tactile member (35). The top portion of the intermediate housing part (30) may comprise an indentation (32) for guiding a first part **(35*a*) of the resilient tactile member (35)**.

The rotatable member (40) may comprise at least one protrusion (39) adapted to engage with an engaging part (38) of the resilient tactile member (35).

The first part **(35*a*) of the resilient tactile member (35) may be substantially U-shaped, and said first part (35*a*) being substantially perpendicular to the engaging part (38)**.

The at least one protrusion (39) of the rotatable member (40) may be adapted to engage with the resilient tactile member (35) so as to provide an audible feedback signal in addition to the tactile feedback. The predetermined angular position of the rotatable member (40) may be different from or equal to an angular position of the rotatable member (40) causing the resilient conductive member (8) to switch between the first and second switch states.

The resilient conductive member (8) may comprise a first part (9*a*, 9*b*) adapted to engage with the protrusion (21) of the intermediate link (20).

The resilient conductive member (8) may comprise a detent spring manufactured in a material selected from the group consisting of: stainless steel, spring steel, low carbon steel, metallic alloys and Palladium alloys. The resilient conductive member (8) may be manufactured monolithically.

The resilient tactile member (35) may comprise a detent spring manufactured in a material selected from the group consisting of: stainless steel, spring steel, low carbon steel, and Palladium alloys. The resilient tactile member (35) may be manufactured monolithically.

The assembly may further comprise a user operable knob (50) connected to the rotatable member (40), the user operable knob (50) comprising means for providing friction with a user's finger.

The base plate (1) may be manufactured in a material selected from the group consisting of: heat resistive thermoplastics, insulating ceramics, LCP, PVC, PE, PP, and Polyetheretherketone. The intermediate housing part (30) may be manufactured in a material selected from the group consisting of: insulating ceramics, PVC, PE, PP, and Polyamide.

The variable resistance means may comprise a substrate (10) supporting a conductive path (14) on a surface thereof, wherein a first end portion of the conductive path (14) is electrically connected to the third (11) conductive leg, and a slidable contact (22) adapted to slide along the conductive path (14) upon rotation of the rotatable member (40), the slidable contact (22) further being in electrical contact with the fourth conductive leg (13).

The variable resistance means may further comprise a fifth conductive leg (12) electrically connected to a second end portion of the conductive path (14). The substrate (10) supporting the conductive path (14) may comprise a PCB.

As described for the conductive switch legs (2,3) it is understood that the term "leg" is not limiting with respect to third, fourth and fifth conductive legs (11,12,13). These conductive legs (11,12,13) may also be shaped as for example flexible wires, flexprint or bumps etc.

An outer diameter of the assembly may be in the range 1–4 mm, preferably in the range 2–3 mm. By an outer diameter is understood an outer diameter including a suitable outer protective housing part of the volume control and switch assembly.

A total height of the assembly is in the range 1,5–4,5 mm, preferably in the range 2,5–3,5 mm.

In a second aspect, the invention relates to a hearing aid comprising an integral volume control and switch assembly according to the first aspect.

In a third aspect, the invention relates to a portable communication device comprising an integral volume control and switch assembly according to the first aspect.

BRIEF DESCRIPTION OF THE FIGURES

The present invention will now be explained with reference to the accompanying figures, where.

While the invention is susceptible to various modifications and alternative forms, specific embodiments have been shown only by way of examples. However, it should be understood that the invention is not intended to be limited to the particular embodiments disclosed. Rather, the invention is to cover all modifications, equivalents, and alternatives falling within the spirit and scope of the invention as defined by the appended claims.

DETAILED DESCRIPTION OF THE INVENTION

Figure 1:
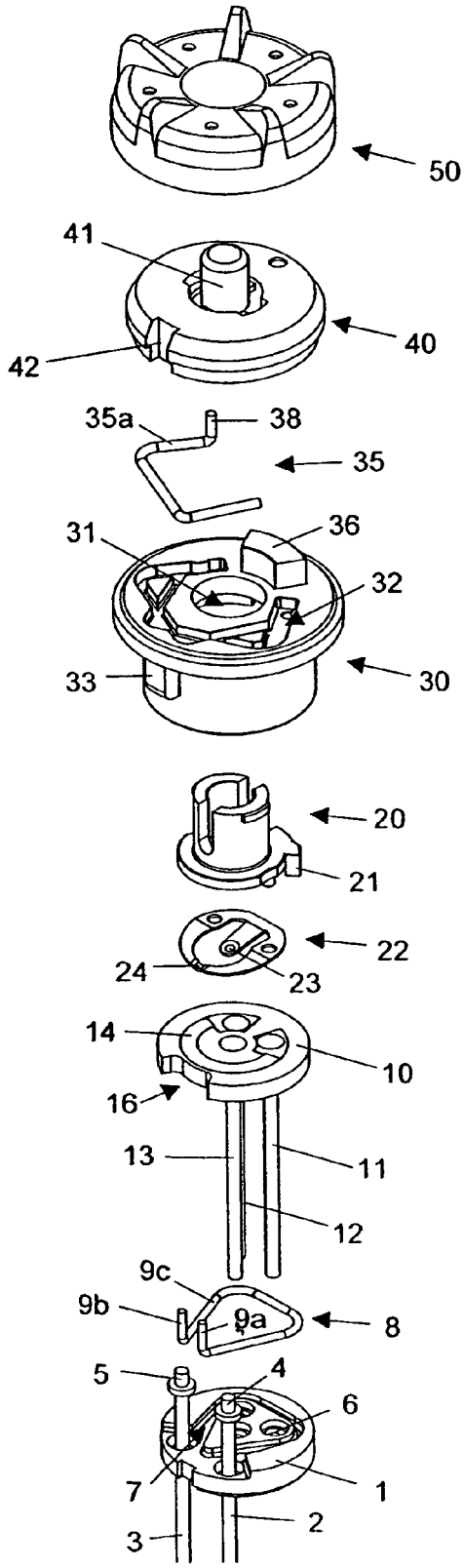
FIG. 1 shows an exploded view of selected parts of an assembly according to the invention.

FIG. 1 shows a perspective view of selected parts of the assembly according to the invention showing from below a base plate 1 comprising first 2 and second 3 conductive switch legs. The first 2 and second 3 conductive switch legs penetrate the base plate 1 and form two terminals 4, 5, respectively, on an upper surface of the base plate 1. It is understood that even though denoted "legs" the first 2 and second 3 conductive switch legs may be formed differently than the long slim members or pins shown in the Figures. For example the switch legs 2,3 may be formed by conductive bumps adapted for soldering or they may be formed by pieces of Printed Circuit Boards (PCB), pieces of flexprint or flexible wires.

The base plate 1 further comprises three holes 6 for receiving third 11, fourth 12 and fifth 13 conductive legs mounted on substrate 10. These legs 11,12,13 form the termination of the 3-pin potentiometer part of the assembly. One of conductive legs 11 or 12 may be omitted, if preferred, thus leaving the potentiometer part in a 2-pin version providing an adjustable resistance value between the two legs 11,13 or 12,13.

The base plate 1 also comprises an indentation 7 fitted to receive and support a resilient conductive member 8. The resilient conductive member 8 is a detent spring having a first part 9*c* positioned in the indentation 7 and second parts 9*a*, 9*b* oriented substantially perpendicular to the first part 9*c*. The second part 9*a* of the resilient conductive member 8 is intended to co-operate with a protrusion 21 of the intermediate link 20, in order to change switch state, i.e. establish or break the electrical connection between the two terminals 4, 5 and hence the first 2 and second 3 conductive switch legs. The indentation 7 is preferably wider near the point of engagement between the resilient conductive member 8 and the protrusion 21 so as to allow bending of the first part 9*c* of the resilient conductive member 8 positioned in the indentation 7.

The substrate 10 comprises a conductive path 14 on a surface thereof. Third and fourth conductive legs 11, 12 penetrate the substrate 10 so as to be electrically connected to opposite end portions of the conductive path 14. The fifth conductive leg 13 is preferably positioned near the centre of the substrate 10 as the fifth conductive leg 13 is adapted to be in electrical contact with a centre mounted contact element 23 of a slidable contact 22 formed as a wiper, the slidable contact 22 further having a contact point 24 adapted for electrical contact with the conductive path 14. Preferably, the substantially circular substrate 10 comprises an indentation 16 so as to let the second part 9*a*, 9*b* of the resilient conductive member 8 extend above the substrate 10.

The intermediate link 20 has the slidable contact 22 rigidly mounted to its lower side. In a well-known manner the conductive legs 11, 12, 13, the conductive path 14, and the slidable contact are capable of constituting a conventional voltage divider where the rotation of the conductive wiper 22 provides two mutually dependent variable resistance values between the third conductive leg 11 and the fifth conductive leg 13, and between the fourth conductive leg 12 and the fifth conductive leg 13, respectively.

As mentioned, the intermediate link 20 comprises a protrusion 21 adapted to engage with the second part 9*b* of the resilient conductive member 8. The protrusion 21 is preferably manufactured in a material appropriate for the engagement with the resilient conductive member 8, such as insulating ceramics, PVC, PE, PP or similar. Polyamide 6.6 with 50% glass is a preferred choice of material for the intermediate link 20. Preferably, the intermediate link 20 and the protrusion 21 are manufactured, e.g. moulded, in one piece to simplify manufacturing.

An intermediate housing part 30 comprises a through-going opening 31 suited for receiving and preferably supporting the intermediate link 20 in such a way as to allow the intermediate link 20 to rotate at least part of a full revolution. The intermediate housing part 30 preferably comprises a U-shaped indentation 32 adapted to receive and support a resilient tactile member 35 formed as a detent spring. The leg parts of the U-shaped indentation 32 are wider than the bottom part of the U-shaped indentation 32 so as to allow bending of a first part 35*a* of the resilient tactile member 35 when positioned in the leg parts of the U-shaped indentation 32. The resilient tactile member 35 comprises a second part 38 oriented substantially perpendicular to the first part 35*a*. The intermediate housing part 30 preferably comprises a projection part 36 that supports the rotatable member 40. In addition, the projection part 36 serves as stopping means by preventing damage of the assembly that would occur by overturning the rotatable member 40. As the rotatable member 40 is turned in one direction relative to the intermediate housing part 30 a protrusion 39 (further described in the following) of the rotatable member 40 will at one point of the rotation engage with the projecting part 36 that will thus hinder further rotation of the rotatable member 40 in the same direction. The same applies by rotation of the rotatable member 40 in the opposite direction. The intermediate housing part 30 also comprises an outer projection 33 for easy and reliable mounting/fixing of the assembly in a device, such as in a face plate of a hearing aid.

The resilient conductive member 8 is formed as a separate member from the contact parts 4,5 with which the resilient conductive member 8 is adapted to engage. If preferred, the switching mechanism according to the invention may be arranged so that the resilient conductive member 8 can be formed integral with one of the contact parts 4,5 and consequently integral with one of the conductive switch legs 2,3.

A rotatable member 40 is rigidly connected to the intermediate link 20 in order to transfer rotational displacement of the rotatable member 40 to the intermediate link 20. Preferably, the rigid connection is established by designing the rotatable member 40 and the intermediate link 20 to be combined or forced together in a locking engagement. Alternatively, the rotatable member 40 and the intermediate link 20 are joined by welding, gluing or similar. Rotation of the rotatable member 40 and the intermediate link 20 is preferably performed around a substantially central axis of the assembly. Preferably the fifth conductive leg 13 is also positioned in the axis of rotation.

A knob 50 for user friendly interaction may be provided on top of the rotatable member 40 so as to allow a user to easily operate the assembly. The knob 50 is preferably joined to the rotatable member 40 by fastening on a central projection 41 of the rotatable member 40 and an indentation 42 of the rotatable member 40, e.g. by a locking engagement or similar methods. The knob 50 shown has a number of wings adapted to provide sufficient friction to a user's finger during operation. The knob 50 may be omitted if preferred or made integral with the rotatable member 40.

Figure 2:
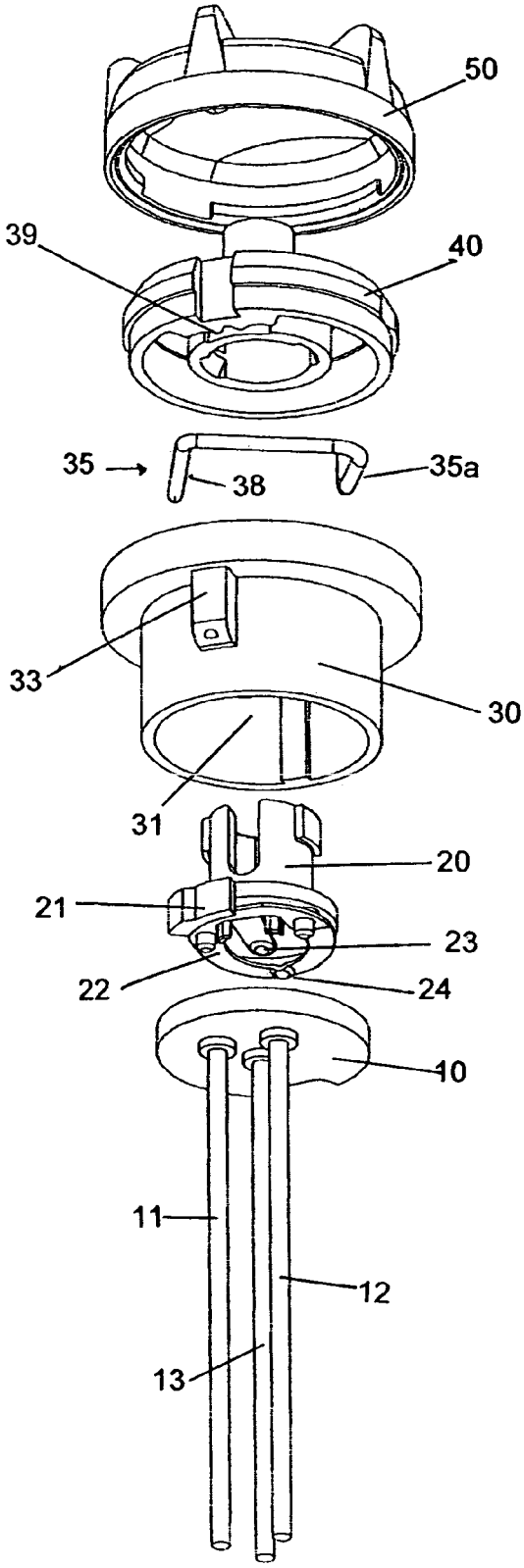
FIG. 2 shows an exploded view of a slightly different embodiment in a different view relative to FIG. 1, FIGS. 3A and 3B show the assembly according to the invention in a first and a second switch state, respectively, viewed in partly cut-away sections.

FIG. 2 shows a different perspective view of selected parts of the assembly according to the invention. Bottom part of the rotatable member 40 comprises an opening adapted to fit to a top of the intermediate link 20. The rotatable member 40 also comprises a protrusion 39 adapted to engage with the second part 38 of the resilient tactile member 35 upon rotation of the rotatable member 40. It is apparent that an angular position of the tactile engagement relative to an angular position of the top member 40 where a change of switch state occurs can be chosen with a high degree of freedom. Thus, a timing experienced by the user between change of switch state and tactile feedback upon rotation of the rotatable member 40 can be varied. This timing corresponds to an angular difference of the rotatable member 40 between the point of engagement of the protrusion 39 and the second part 38 of the resilient tactile member 35 versus the point of engagement of the protrusion 21 of the intermediate link 20 with the second part 9*b* of the resilient conductive member 8.

The angular difference between change of switch state and tactile feedback can be adjusted on the shown embodiment in several ways. For example the rotatable member 40 may be turned into another angular position when locked into engagement with the intermediate link 20. Another way to adjust the switch function in relation to the tactile feedback is by providing a rotatable member 40 with its protrusion 39 positioned at another angular position relative to its locking mechanism for engagement with the intermediate link 20. Still another way of adjusting the switch function in relation to the tactile feedback is by providing an intermediate link 20 with its protrusion positioned at another angular position relative to its locking mechanism for engagement with the rotatable member 40.

The detailed kind of engagement between the protrusion 39 and the second part 38 of the resilient tactile member 35 can be performed in a variety of ways and a variety of tactile and also acoustic effects experienced by a user can be obtained. Due to the fact that the tactile feedback arrangement, formed by the resilient tactile member 35 and the protrusion 39, is separated from the switch arrangement formed by the protrusion 21 of the intermediate link 20 actuating the second part 9*b* of the resilient conductive member 8, a variety of different schemes for timing of tactile feedback relative to the electrical switch function can be provided. Only a few examples will be given below.

In a first embodiment of the engagement between the protrusion 39 and the second part 38 of the resilient tactile member 35 the protrusion 39 has a slope as viewed in a profile view that bends the second part 38 of the resilient tactile member 35 away from its equilibrium position upon engagement. The engagement provides the user with an increasing mechanical resistance towards rotation of the rotatable member 40 depending on the rate of increase of the slope and a stiffness of the resilient tactile member 35. In particular the stiffness of the second part 38 of the resilient tactile member 35 but also a stiffness of the first part 35*a* of the resilient tactile member 35 influences the mechanical resistance that will be experienced by the user. Preferably, the slope of the protrusion 39 has a linear slope, but as an alternative to a linear slope, the slope might have a concave shape, a convex shape, a step-ladder shape, or similar. Preferably, a surface of the protrusion 39 is coated or treated to facilitate different kinds of engagement with the second part 38 of the resilient tactile member 35.

So as to protect the potentiometer part from dirt and moist, the intermediate link 20 is fitted to the opening 31 in the intermediate housing part 30 substantially water-tight. This is crucial for example for hearing aid applications where it is essential that the volume and switch assembly is capable of reliable operation in a humid environment, i.e. the assembly needs to be at least substantially sweat-tight.

In a second embodiment of the engagement between the protrusion 39 and the second part 38 of the resilient tactile member 35, the protrusion 39 has a maximum as viewed in a profile view. In this embodiment the user experiences an initially increasing mechanical resistance towards rotation of the rotatable member 40 being similar to the first embodiment described above. However, as the second part 38 of the resilient tactile member 35 reaches the maximum, the mechanical resistance will decrease relatively upon further rotation of the rotatable member 40, thus providing the user with a different type of tactile feedback relative to the first embodiment. Preferably, the protrusion 39 has more than one maximum as viewed in a profile view.

In a third embodiment of the engagement between the protrusion 39 and the second part 38 of the resilient tactile member 35, the protrusion 39 has an abrupt or discontinuous maximum following by a steep decline as viewed in a profile view. This can be considered as a special case of the second embodiment described above. The steep decline allows the second part 38 of the resilient tactile member 35, at least for a short period of time, to accelerate towards a stop part of the protrusion 39 to provide a mechanical impact by the second part 38 of the resilient tactile member 35 on said stop of the protrusion 39. This mechanical impact will result in an audible sound to the user, thereby informing the user about the change of switch state of the assembly via an audible click sound. Preferably, the audible sound is combined with a mechanical tactile feedback.

Optionally, the protrusion 39 is specifically treated or prepared at the point of the mechanical impact to enhance the audible sound. The protrusion may e.g. be metallised or similarly. In addition, the rotatable member 40 and/or the knob 50 may be designed specifically with respect to enhance their ability to transmit vibrations resulting from mentioned impact so as to enhance the acoustic signal radiated by external elements of the assembly, such as the knob 50.

As seen from FIGS. 1 and 2, the resilient conductive member 8 as well as the resilient tactile member 35 are formed by metal wire bent into a desired shape. In this way the resilient property of the resilient members 8, 35 is provided by a spring effect. These parts are easy to manufacture and easy to handle and fit to the remaining part of the assembly, thus facilitating the production process also in miniature versions of the assembly.

Due to its conductive function the resilient conductive member 8 is preferably formed by an electrically conductive material. However, the resilient members 8, 35 may be formed by different materials. The resilient tactile member 35 may be formed in an electrically non-conductive material such as a polymeric material that is capable of providing a spring effect so as to provide a tactile sensation to a user upon interaction of the resilient tactile member 35 with the protrusion 39 of the rotatable member 40.

Preferred materials for the resilient conductive member 8 is Paliney 6, i.e. a Palladium-Silver based alloy. Another suitable material for the resilient conductive member 8 is Hera, which is a Palladium, Copper, Silver and Nickel based alloy. The same materials mentioned for the resilient conductive member 8 are also suitable for the slidable contact 22. The resilient tactile member 35 is preferably manufactured in stainless steel such as W No. 1.4310. At least the material for the resilient tactile member 35 must provide a spring effect. All terminals, i.e. conductive switch legs 2, 3 as well as conductive legs 11, 12, 13 are preferably manufactured in a silver alloy plated with 2 $\mu$m gold, such as AgCu 97/3. Preferred materials for intermediate link 20, intermediate housing part 30, rotatable member 40 as well as knob 50 is Ultramid A3EG10, i.e. Polyamide 6.6 comprising 50% glass. Materials for the base plate 1 must be able to withstand heat from welding. A preferred material for the base plate 1 is Victrex PEEK GL30, i.e. Polyetheretherketone comprising 30% glass.

Figure 3A:
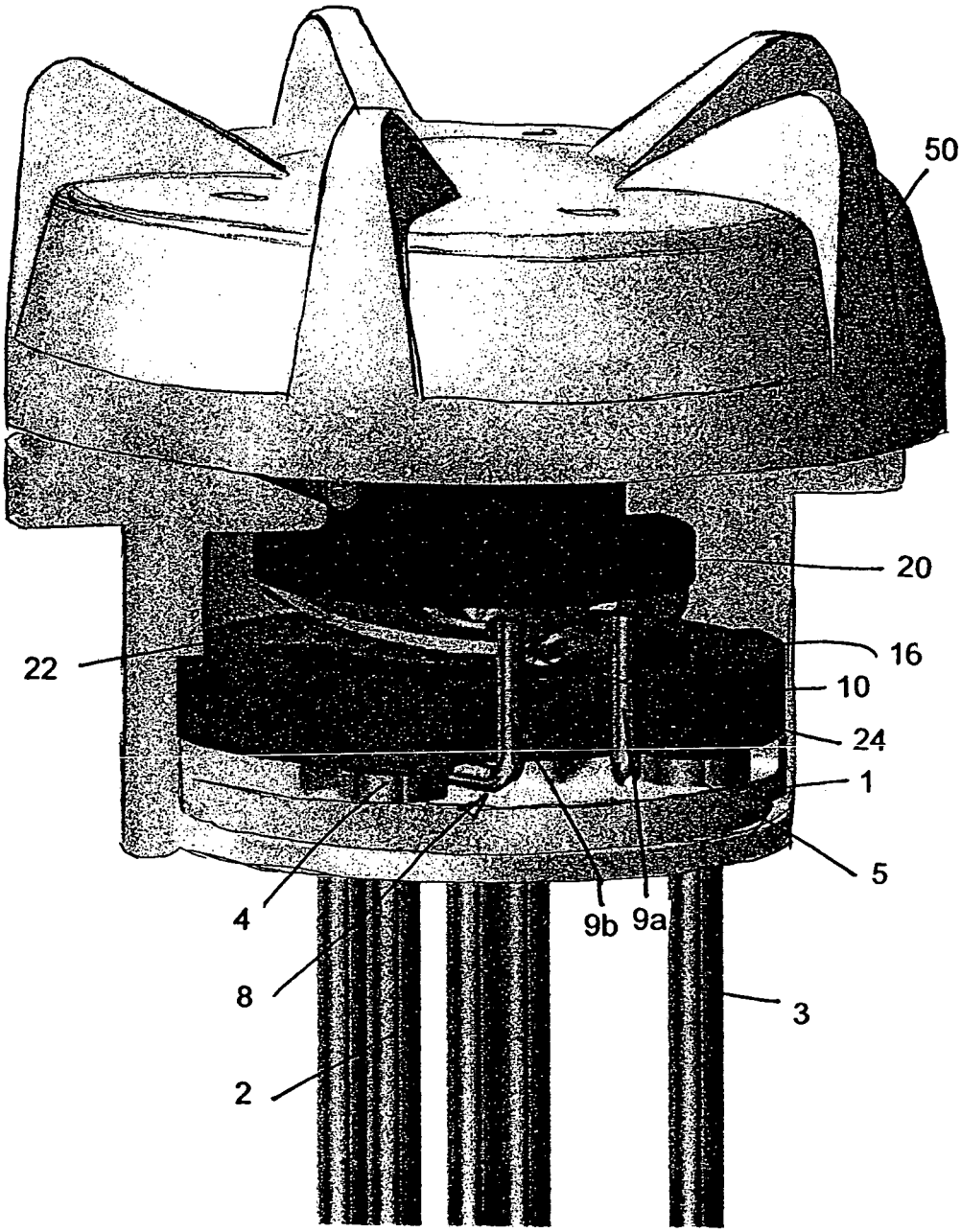
Figure 3B:
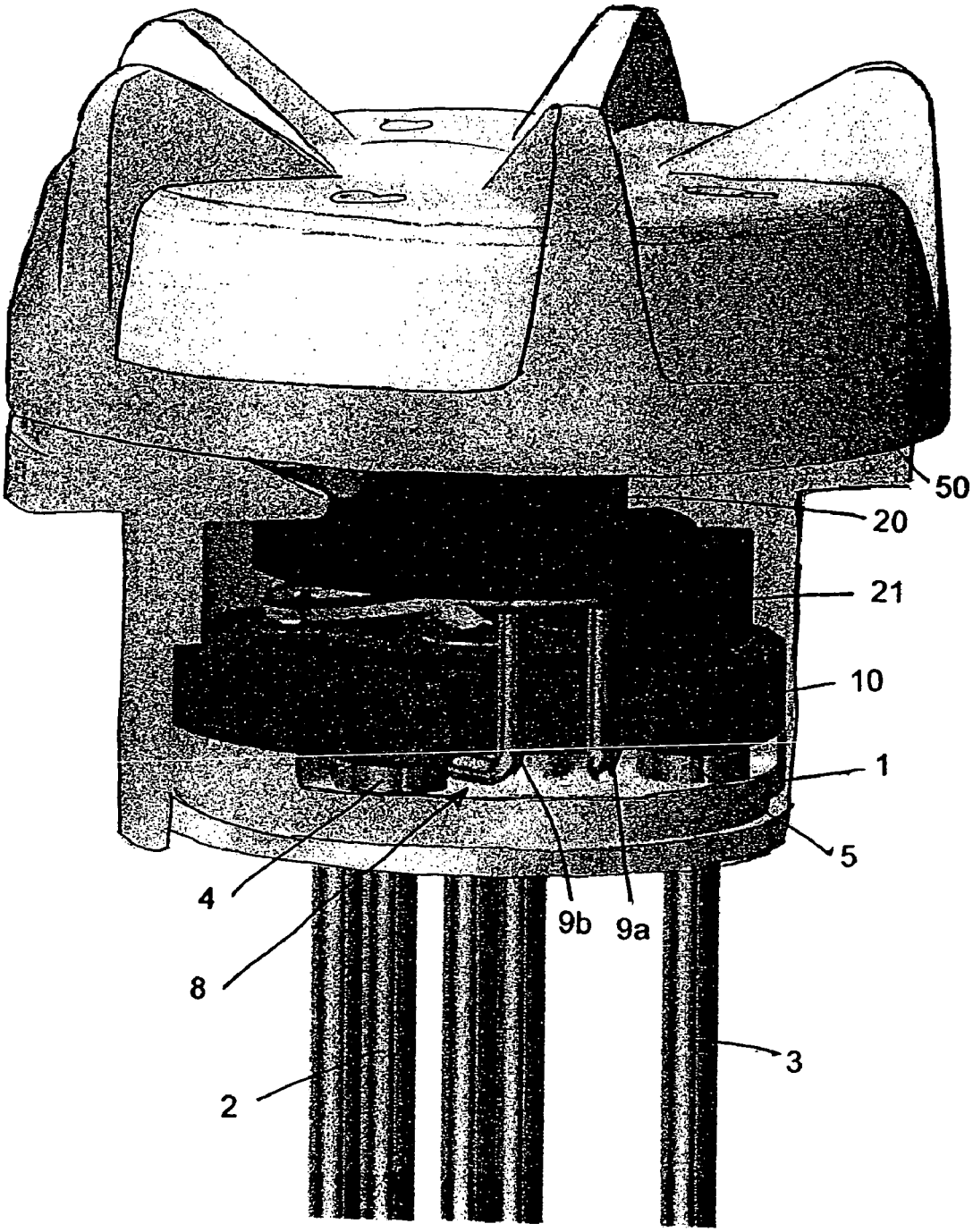

FIGS. 3A and 3B show the assembly according to the invention in a first and a second switch state, respectively, both viewed in a partly cut-away section.

FIG. 3A shows one leg 9*a* of the first part 9*a*, 9*b* of the resilient conductive member 8 being in electrical contact with the upper contact terminal 5, the contact terminal 5 forming an upper part of the conductive leg 3. Likewise, the contact terminal 4 is in electrical contact with another leg 9*b* of first part 9*a*, 9*b* of the resilient conductive member 8, hence an electrical contact between the first 2 and second 3 conductive legs is established in this first switch state of operation. In FIG. 3A it is also apparent how the contact part 24 of the wiper 22 co-operates with the conductive path 14 on the substrate 10 in order to establish electrical contact between a point of the conductive path 14 and the fifth conductive leg 13. Furthermore, it is also shown how the two second parts 9*a*, 9*b* of the resilient conductive member 8 fit in the indentation 16 of the substrate 10 and extend above the substrate 10 to facilitate possible engagement by the protrusion 21 (not shown in FIG. 3A) of the intermediate link 20.

FIG. 3B shows the knob 50, the rotatable member 40 (not visible in FIG. 3B), and the intermediate link 20 turned clockwise approximately a quarter of a full rotation relative to the position illustrated in FIG. 3A, and thus FIG. 3B illustrates the second switch state of operation. In the second switch state the protrusion 21 of the intermediate link 20 is engaged with the second part 9*a* of the resilient conductive member 8, thus forcing this second part 9*a* of the resilient conductive member 8 away from the contact terminal 5, and hence the electrical connection between the contact terminals 4 and 5 is broken in this second switch state of operation. Consequently, electrical connection between conductive switch legs 2,3 is broken in the second switch state.

In principle, the assembly can be brought into the same switch state by turning the rotatably mounted elements 20, 40 and 50 in the opposite direction so that the protrusion 21 engages with the other leg 9*b* of the second part 9*a*,9*b* of the resilient conductive member 8 so as to break the electrical connection between the contact terminal 4 and the resilient conductive member 8. However, preferably as described in connection with FIG. 1, the assembly is designed with appropriate stopping means, such as a projection part 36, so that overturning of the knob 50 and consequently the rotatable member 40 and intermediate link 20 is prevented as this could damage at least the second part 9*a*, 9*b* of the resilient conductive member 8.

Figure 4:
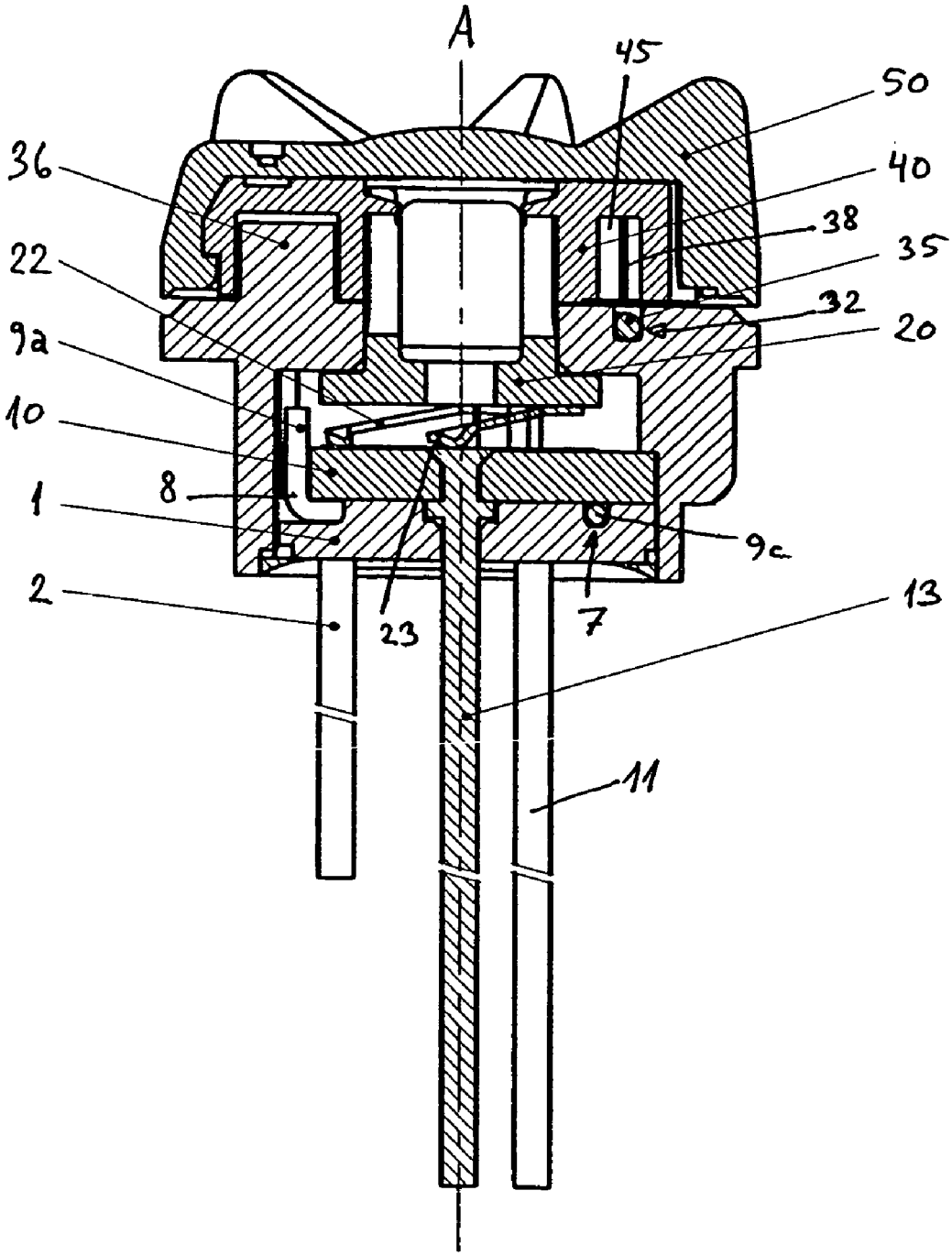
FIG. 4 is a cross-sectional view of an assembled assembly according to the invention.

FIG. 4 shows a cross-sectional view through the centre of an assembled embodiment of the assembly according to the invention with the axis A of rotation indicated. In the cross-section shown in FIG. 4 only three of the contacts members 2, 11, 13 are visible. The central conductive leg 13 penetrates the base plate 1 and the substrate 10 so as to provide electrically contact to the central part 23 of the wiper 22. The second part 9*a* of the resilient conductive member 8 extends with an end portion above the substrate 10 while another part 9*c* of the resilient conductive member 8 resides in the dedicated indentation 7 of the base plate 1. At the centre of the assembly the intermediate link 20 is rotatably mounted in the intermediate housing part 30 and the intermediate link 20 is rigidly connected with the rotatable member 40. The rotatable member 40 is rigidly connected to the knob 50. A part 35*a* of the resilient tactile member 35 is shown positioned in the indentation 32 of the intermediate housing part 30. The second part 38 of the resilient tactile member 35 can move freely in the cavity 45 of the rotatable member 40 until the second part 38 of the resilient tactile member 35 engages with a protrusion 39 (not visible in FIG. 4) of the rotatable member 40.

As it is seen from FIG. 4, in the engagement between the intermediate housing part 30 and the rotatable member 40, the size of the projection 36 is larger than the size of the cavity 45. Therefore, full rotation of the rotatably mounted parts 20, 40, and 50 is prevented. At a certain point of rotation, the projecting part 36 will meet a part of the cavity 45 of the rotatable member 40 being smaller than the projecting part 36, and thus further rotation of the rotatable member 40 relative to the intermediate housing part 30 is hindered. In FIG. 2 the rotatable member 40 is seen from below, and it is seen that the projecting part 36 will be stopped when reaching the protrusion 39. However, other positions may be chosen for position of a stop member, for example so as to allow only a small fraction of a full rotation of the rotatable member 40 relative to the intermediate housing 30.

A volume control and switch assembly according to the invention and according to the shown embodiments may be manufactured in a variety of sizes adapted to fit into different miniature applications such as portable audio devices for entertainment such as portable MP3 players, CD players or portable radios. The assembly may also be manufactured in sizes small enough to fit hearing aid applications while still acceptable with respect to large scale manufacturing.

The invention claimed is:

1. An integral volume control and switch assembly comprising a base plate being penetrable by first and second conductive switch legs, the base plate further supporting a resilient conductive member adapted to establish an electrical connection between the first and second conductive switch legs in a first switch state of the assembly, and adapted to break said electrical connection in a second switch state, a variable resistance means responsive to an angular position of a rotatable member, the variable resistance means being electrically connected between third and fourth conductive legs, and a resilient tactile member adapted to provide a tactile feedback to a user at a predetermined angular position of the rotatable member, to indicate to the user, a change between the first and second switch states, wherein the resilient tactile member is electrically separate from the electrical connection between the first and second conductive switch legs.

2. An integral volume control and switch assembly according to claim 1, wherein the resilient tactile member and the resilient conductive member are spatially separated along a rotational axis of the rotatable member.

3. An integral volume control and switch assembly according to claim 1, wherein the resilient conductive member and the switch legs constitute separate members.

4. An integral volume control and switch assembly according to claim 1, further comprising an intermediate link rigidly connected to the rotatable member, the intermediate link comprising a protrusion being adapted to engage with the resilient conductive member so as to either establish or break the electrical connection between the first and second switch legs.

5. An integral volume control and switch assembly according to claim 4, wherein the resilient conductive member comprises a first part adapted to engage with the protrusion of the intermediate link.

6. An integral volume control and switch assembly according to claim 1, further comprising an intermediate housing part being rigidly connected to the base plate, the intermediate housing part having a top portion aligned with the base plate, wherein the top portion supports the resilient tactile member.

7. An integral volume control and switch assembly according to claim 6, wherein the top portion of the intermediate housing part comprises an indentation for guiding a first part of the resilient tactile member.

8. An integral volume control and switch assembly according to claim 6, wherein the intermediate housing part is manufactured in a material selected from the group consisting of: insulating ceramics, PVC, PE, PP, and Polyamid.

9. An integral volume control and switch assembly according to claim 1, wherein the rotatable member comprises at least one protrusion adapted to engage with an engaging part of the resilient tactile member.

10. An integral volume control and switch assembly according to claim 9, wherein the first part of the resilient tactile member is substantially U-shaped, and wherein said first part is substantially perpendicular to the engaging part.

11. An integral volume control and switch assembly according to claim 9, wherein the at least one protrusion of the rotatable member is adapted to engage with the resilient tactile member so as to provide an audible feedback signal in addition to the tactile feedback.

12. An integral volume control and switch assembly according to claim 9, wherein the predetermined angular position of the rotatable member is different from an angular position of the rotatable member causing the resilient conductive member to switch between the first and second switch states.

13. An integral volume control and switch assembly according to claim 9, wherein the predetermined angular position of the rotatable member is substantially equal to an angular position of the rotatable member causing the resilient conductive member to switch between the first and second switch states.

14. An integral volume control and switch assembly according to claim 1, wherein the resilient conductive member comprises a detent spring manufactured in a material selected from the group consisting of: stainless steel, spring steel, low carbon steel, metallic alloys and Palladium alloys.

15. An integral volume control and switch assembly according to claim 1, wherein the resilient conductive member is manufactured monolithically.

16. An integral volume control and switch assembly according to claim 1, wherein the resilient tactile member comprises a detent spring manufactured in a material selected from the group consisting of: stainless steel, spring steel, low carbon steel, and Palladium alloys.

17. An integral volume control and switch assembly according to claim 1, wherein the resilient tactile member is manufactured monolithically.

18. An integral volume control and switch assembly according to claim 1, further comprising a user operable knob connected to the rotatable member, the user operable knob comprising means for providing friction with a user's finger.

19. An integral volume control and switch assembly according to claim 1, wherein the base plate is manufactured in a material selected from the group consisting of: heat resistive thermoplastics, insulating ceramics, LCP, PVC, PE, PP, and Polyetheretherketone.

20. An integral volume control and switch assembly according to claim 1, wherein the variable resistance means comprises a substrate supporting a conductive path on a surface thereof, wherein a first end portion of the conductive path is electrically connected to the third conductive leg, and a slidable contact adapted to slide along the conductive path upon rotation of the rotatable member, the slidable contact further being in electrical contact with the fourth conductive leg.

21. An integral volume control and switch assembly according to claim 20, further comprising a fifth conductive leg electrically connected to a second end portion of the conductive path.

22. An integral volume control and switch assembly according to claims 20, wherein the substrate supporting the conductive path comprises a PCB.

23. An integral volume control and switch assembly according to claim 1, wherein an outer diameter of the assembly is in the range 1–4 mm, preferably in the range 2–3 mm.

24. An integral volume control and switch assembly according to claim 1, wherein a total height of the assembly is in the range 1,5–4,5 mm, preferably in the range 2,5–3,5 mm.

25. A hearing aid comprising an integral volume control and switch assembly according to claim 1.

26. A portable communication device comprising an integral volume control and switch assembly according to claim 1.

* * * * *